US006581588B2

(12) United States Patent
Wiedemann et al.

(10) Patent No.: US 6,581,588 B2
(45) Date of Patent: Jun. 24, 2003

(54) DOOR OF INSULATING GLASS FOR A COOKING CHAMBER OF A COOKING APPLIANCE

(75) Inventors: Peter Wiedemann, Klosterleehfield (DE); Willi Winter, Augsburg (DE); Hermann Rabe, Landsberg (DE)

(73) Assignee: Rational Aktiengesellschaft, Landsberg/Lech (DE)

( * ) Notice: Subject to any disclaimer, the term of this patent is extended or adjusted under 35 U.S.C. 154(b) by 12 days.

(21) Appl. No.: 09/910,513

(22) Filed: Jul. 19, 2001

(65) Prior Publication Data

US 2002/0007829 A1 Jan. 24, 2002

(30) Foreign Application Priority Data

Jul. 24, 2000 (DE) ..... 100 36 030

(51) Int. Cl.[7] ..... F23M 7/00; F24C 15/04
(52) U.S. Cl. ..... 126/200
(58) Field of Search ..... 52/172; 126/194, 126/200, 123, 198

(56) References Cited

U.S. PATENT DOCUMENTS 5,105,591 A * 4/1992 Leopold ..... 52/172
5,881,710 A * 3/1999 Davis et al. ..... 126/194

FOREIGN PATENT DOCUMENTS

| | | |
|---|---|---|
| DE | 833 849 | 3/1952 |
| DE | GM 77 06 648 | 6/1977 |
| DE | 42 40 096 | 6/1994 |
| EP | 0 644 378 | 3/1995 |
| FR | 2.113.196 | 6/1972 |
| FR | 2 474 654 | 7/1981 |

* cited by examiner

*Primary Examiner*—Henry Bennett
*Assistant Examiner*—Sabrina Dagostino
(74) *Attorney, Agent, or Firm*—Schiff Hardin & Waite

(57) ABSTRACT

An insulating glass door for a cooking chamber of a cooking appliance is formed by an insulating glass window composed of two individual panes which are spaced apart for forming an interspace therebetween, which is sealed by an insulating material. The door includes at least one door component which is integrated and extends between the two spaced-apart panes.

13 Claims, 3 Drawing Sheets

DOOR OF INSULATING GLASS FOR A COOKING CHAMBER OF A COOKING APPLIANCE

BACKGROUND OF THE INVENTION

The present invention is directed to a door of insulating glass for a cooking chamber.

Insulating glass is well known. It is basically composed of at least two individual panes that are joined to one another so that a sealed interspace remains between these individual panes. This interspace is filled with a gas, such as air, inert gas and, potentially, additives, such as drying agents. This gas is responsible for a good insulating property of the glass.

Insulating glass is known from the window industry, but is also employed in the cooking appliance industry and is utilized therein in various forms in thermal cooking appliances. In general, insulating glass panes are introduced into a cooking chamber door frame, so that various door components, such as hinges, locking mechanisms, light sources, for example illuminating the cooking chamber, or the like can be arranged in this cooking chamber door frame. It is problematical in this context that given a traditional cooking chamber door, the attachment of the door components is complicate. In addition, the stability when swinging the cooking chamber door open is inadequate and a comparatively complicated structure is present overall, which results in unsatisfactory price and/or performance ratio.

European Application EP 0 644 378 A2 discloses a cooking appliance comprising a vertically suspended access door that is provided with an outside glazing and comprises an inner door that is arranged on the inside of the access door. The inner door is provided with hinges along an edge of the access door and, with the assistance of the hinges, can be moved into a position that separates the inside door from the access door.

German 833 849 discloses a double door to be employed for a cooking appliance. The door lying closest to the cooking chamber is fashioned as a glass door and is covered by the outer door. The two doors are releasably coupled to one another by a coupling to be operated by the handle of the outer door.

SUMMARY OF THE INVENTION

The present invention is based on the object of providing a door of insulating glass for a cooking chamber for a cooking appliance that can be simply as well as cost-beneficially manufactured and that comprises an uncomplicated structure.

This object is inventively achieved by a door of insulating glass for a cooking chamber of a cooking appliance comprising an insulating glass window composed of at least two individual panes, which are selected from single-pane security glasses, composite glasses and combinations thereof. The panes are arranged to define one interspace between them which can be at least partially insulated by a seal, wherein at least one spacer is arranged for maintaining the interspace and wherein at least one member selected from at least one door component and a pivot point is integrated or can be integrated into the door.

It is thereby provided that the door components are selected from a group consisting of a hinge, a locking mechanism, cables for a light source and combinations thereof.

It is inventively proposed that at least one door component, particularly a hinge, a locking mechanism, a pivot point and combinations thereof, is at least partially accommodated or can be at least partially accommodated in at least one spacer between the individual panes.

It is also provided that the seal comprises at least one recess for at least one door component, particularly a light source, preferably along a common edge of at least two individual panes.

An embodiment of the invention is also characterized by at least one glass member, such as in the form of a glass cylinder with a closed end, which cylinder is positioned in the interspace, preferably joinable to the seal, and is open on one end for the insertion of at least one door component, particularly a light source. The open end is positioned adjacent an edge of the seal so that the interior is freely accessible from the outside of the insulating glass window.

Another embodiment is characterized by at least one spacer between the individual panes that preferably comprises an extruded section fashioned in the form of a passe-partout or channel advantageously on one side or on both sides. It is proposed that the extruded section comprises a cable channel for the light source.

It is also inventively provided that the interspace is at least partially filled with an insulating material or medium selected from air or inert gas with or without an additive like a drying agent or the like.

It is also inventively provided that the insulating glass door is pivotable around a vertical or a horizontal swivel axis by means of pivot points and/or via a hinge.

The invention is thus based on the surprising perception that time and money are saved in the manufacture due to the arrangement of the door components, such as, for example, hinges, locking mechanisms and light sources, with an insulating glass door for a cooking chamber, wherein these are arranged between individual panes of the glass door. The stability when opening and closing the glass door is also improved due to the inventive integration of the pivot point and the interspace between the individual panes of the insulating glass.

Additional features and advantages of the invention will be readily apparent from the following description of the preferred embodiments, the drawings and claims.

DESCRIPTION OF THE PREFERRED EMBODIMENTS

Figure 1:
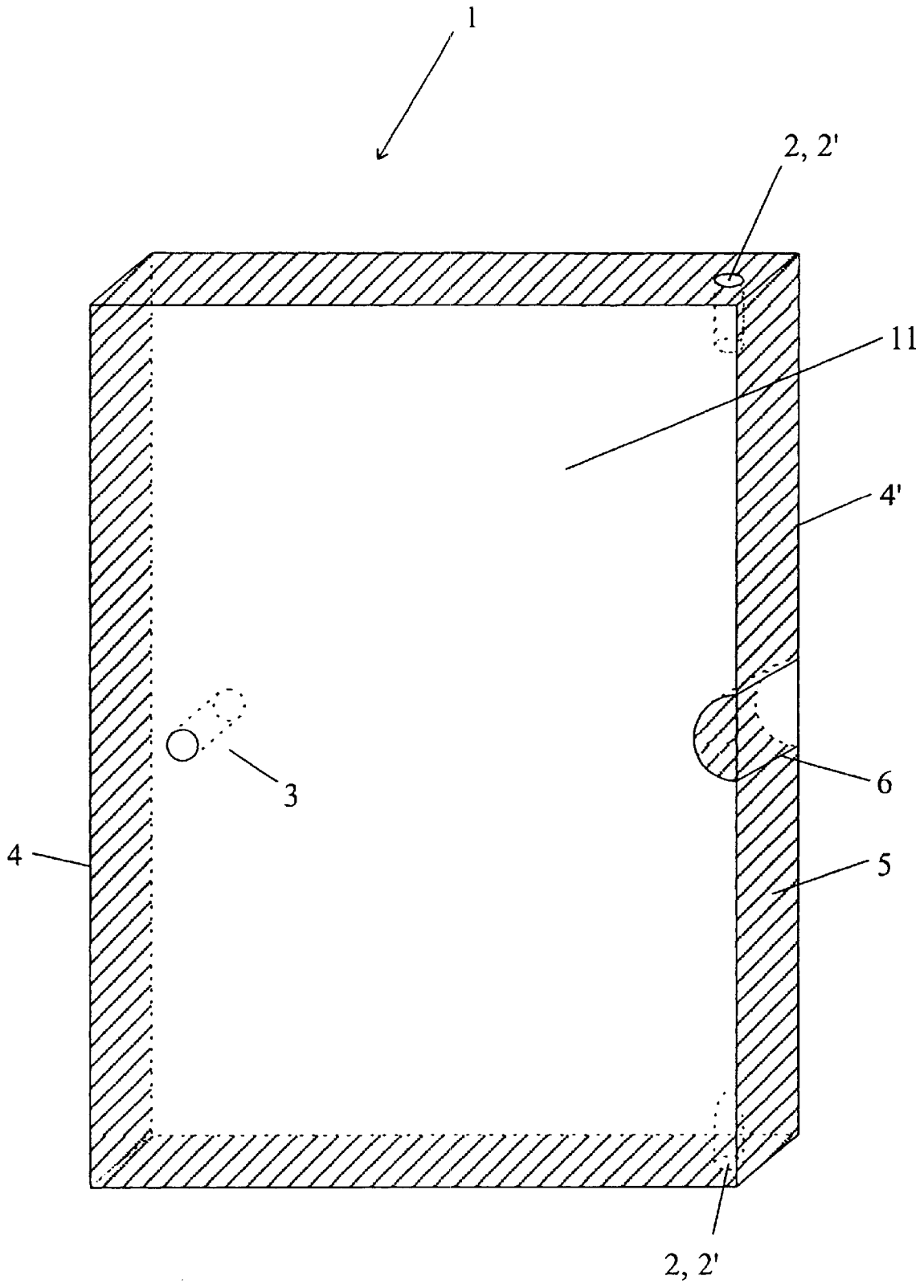
FIG. 1 is a perspective view of a door of insulating glass for a cooking chamber in accordance with the invention.

The principles of the present invention are particularly useful when incorporated in a glass door, generally indicated at 1, for a cooking chamber of a cooking appliance, which are not illustrated to simplify the illustration.

The cooking appliance further includes a housing (not shown) with the cooking chamber (not shown), whose front opening is closed by the insulating glass door 1 of the present invention. The glass door 1 comprises two hinge pins 2 which form pivot points 2' along one side so that the door can pivot around an axis defined by these pivot points 2'. The door 1 also has a locking mechanism 3, which, along with the pivot points, are in the interspace between a first individual pane 4 and a second individual pane 4'. The interspace between the individual panes 4 and 4' is essentially insulated from the outside by a seal 5 (shown with shading), which is of a plastic material and surrounds the periphery of the two panes. The hinges are introduced into the interspace between the individual panes 4 and 4', so that the pivot points, such as 2', are also placed in this interspace and the locking mechanism 3 is integrated into the door 1. A recess 6, which will receive a light source, can be provided in the seal 5 of the interspace between the two individual panes 4 and 4'.

The interspace, further, essentially is filled with an insulating material or medium 11. The insulating material is a gas selected from air and inert gases with or without an additive, such as a drying agent.

Figure 2:
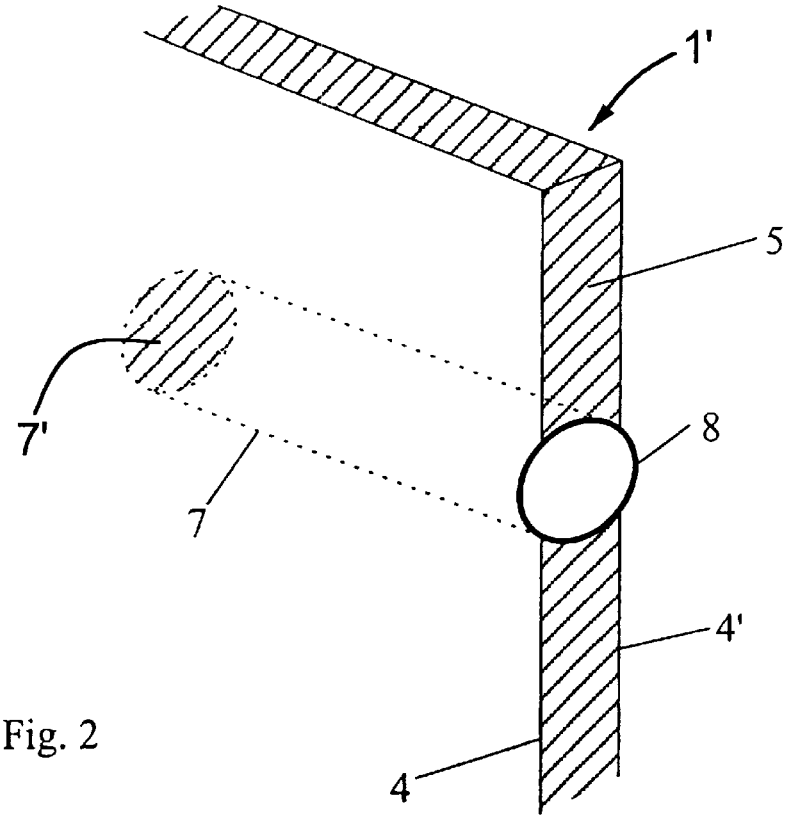
FIG. 2 is a partial perspective view of a second embodiment of a door of insulating glass for a cooking chamber.

A second embodiment of the door is generally indicated at 1' in FIG. 2. In this embodiment, a glass member 7, for example a glass cylinder which is closed at one end 7' (shown with shading) and open at the other end, is placed between the two individual panes 4 and 4' with the open end being open toward an outside edge of the door 1'. The glass member 7 is sealed with a sealant 8 in the edge region of the two individual panes 4 and 4', so that it effectively seals the interspace between the panes 4 and 4' together with the seal 5. A light source (not shown) can be introduced into the open end of the glass member 7 in a simple way without negatively affecting the overall seal of the interspace between the individual panes 4 and 4'.

Figure 3:
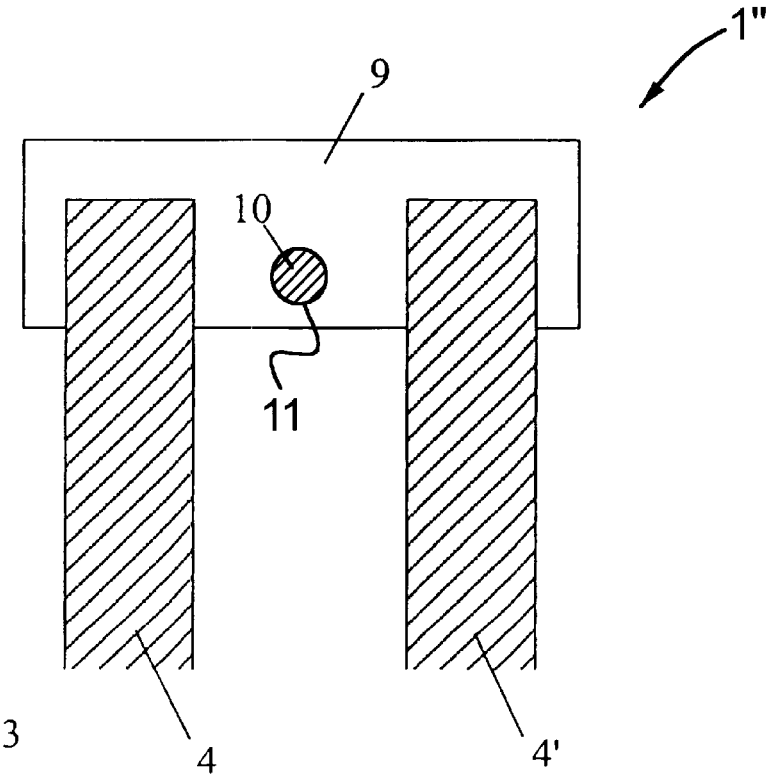
FIG. 3 is a partial cross-sectional view of a third embodiment of a door of insulating glass for a cooking chamber.

A third embodiment of the door is generally indicated at 1" in FIG. 3. The door 1" has a spacer 9 which engages the edges of the panes 4 and 4' and has the form of a passe-partout or channel member. A hinge can be integrally accepted in the spacer 9 or a cable channel 10 for a cable 11 can be arranged in the spacer 9 and the cable 11 extends to a light source (not shown) which may be arranged in the insulating glass door 1" between the panes 4 and 4'.

Figure 4:
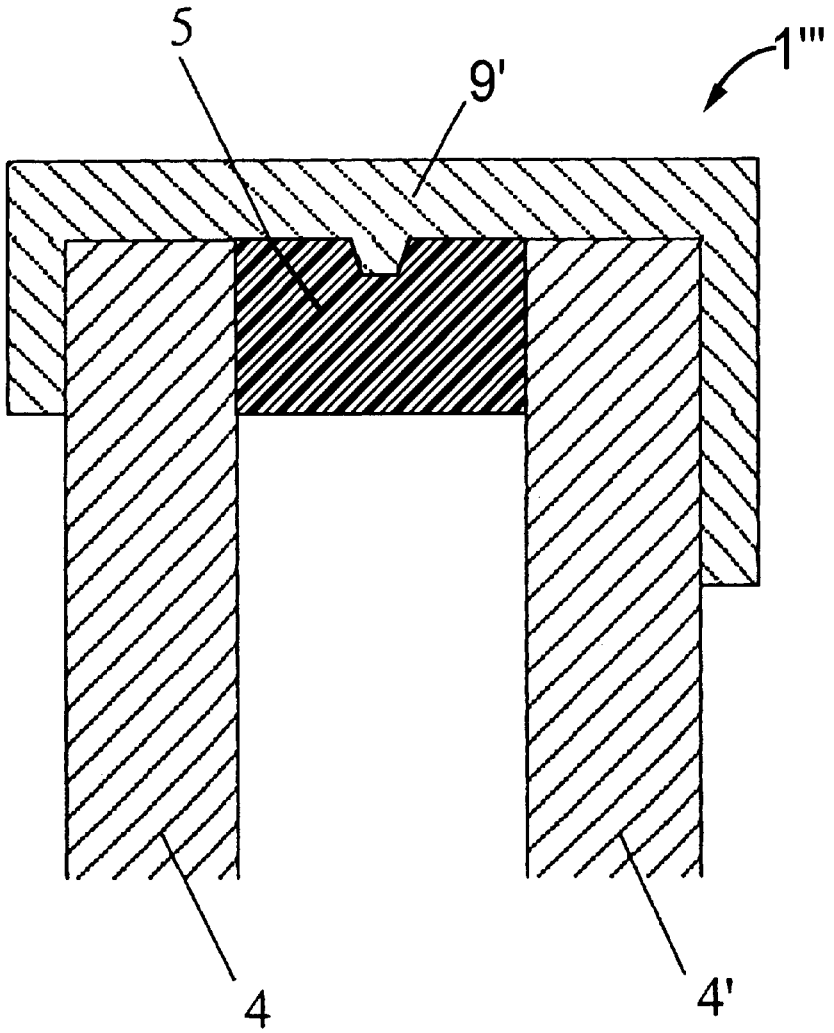
FIG. 4 is a partial cross-sectional view of a fourth embodiment of a door of insulating glass for a cooking chamber.

A fourth embodiment of the door is generally indicated at 11'" in FIG. 4. The door 1'" has a spacer 9' which is in the form of a channel member which covers the edges of the two panes 4 and 4'. The channel member 9 coacts with the seal 5 to seal the edges of the door 1'".

Although various minor modifications may be suggested by those versed in the art, it should be understood that we wish to embody within the scope of the patent granted hereon all such modifications as reasonably and properly come within the scope of our contribution to the art.

We claim:

1. An insulating glass door for an opening of a cooking chamber of a cooking appliance, said insulating glass door having an insulating glass window composed of at least two individual panes selected from single-pane securing glasses, composite glasses and combinations thereof, said individual panes being spaced apart to form one interspace therebetween, a seal of insulating material for sealing the interspace at the edges of said panes, said door including at least one component selected from door components and pivot points for hinges, said component being integrated within the interspace between the individual panes of said door.

2. An insulating glass door according to claim 1, wherein the door components are selected from a hinge, a locking mechanism, a cable, a light source and combinations thereof.

3. An insulating glass door according to claim 1, wherein the at least one door component selected from a hinge, a locking mechanism and combinations thereof is at least partially accommodated in at least one spacer between the individual panes.

4. An insulating glass door according claim 1, wherein the seal includes at least one recess for at least one door component.

5. An insulating glass door according to claim 4, wherein said recess is at a common edge of the two individual panes.

6. An insulating glass door for an opening of a cooking chamber of a cooking appliance, said insulating glass door having an insulating glass window composed of at least two individual panes selected from single-pane securing glasses, composite glasses and combinations thereof, said individual panes being spaced apart to form one interspace therebetween, a seal of insulating material for sealing the interspace at the edges of said panes, said door including at least one component selected from door components and pivot points for hinges, said component being integrated into said door, said door including a glass cylinder closed at one end being disposed in the interspace with an open end extending to an edge of the door, said open end being joined to the seal and being accessible from the outside of the door.

7. An insulating glass door for an opening of a cooking chamber of a cooking appliance, said insulating glass door having an insulating glass window composed of at least two individual panes selected from single-pane securing glasses, composite glasses and combinations thereof, said individual panes being spaced apart to form one interspace therebetween, a seal of insulating material for sealing the interspace at the edges of said panes, said door including at least one component selected from door components and pivot points for hinges, said component being integrated into said door, said door including at least one spacer between the individual panes, said spacer being an extruded section fashioned in the form of a channel having legs engaging the outside surfaces of the panes of glass adjacent the edge thereof.

8. An insulating glass door according to claim 7, wherein the extruded section includes a cable channel for a light source.

9. An insulating glass door according to claim 1, wherein the interspace is at least partially filled with an insulating material, said insulating material being selected from air, inert gas, air with an additive and inert gas with an additive.

10. An insulating glass door according to claim 1, wherein the insulating glass door is pivoted around an axis by pivot points extending within the interspace between the two panes of glass.

11. An insulating glass door according to claim 1, which includes a glass cylinder closed at one end being disposed in the interspace with an open end extending to an edge of the door, said open end being joined to the seal and being accessible from the outside of the door.

12. An insulating glass door according to claim 1, which includes at least one spacer between the individual panes, said spacer being an extruded section fashioned in the form of a channel having legs engaging the outside surfaces of the panes of glass adjacent the edge thereof.

13. An insulating glass door according to claim 12, wherein the extruded section includes a cable channel for a light source.

* * * * *